US006814159B1

(12) United States Patent
Huang

(10) Patent No.: US 6,814,159 B1
(45) Date of Patent: Nov. 9, 2004

(54) IMPACT TOOL DRIVER

(76) Inventor: Shih-Liang Huang, No. 67, Na-Pan-Lin, Hsin-Hua Chen, Tainan Hsien (TW)

( * ) Notice: Subject to any disclaimer, the term of this patent is extended or adjusted under 35 U.S.C. 154(b) by 0 days.

(21) Appl. No.: 10/649,882

(22) Filed: Aug. 26, 2003

(51) Int. Cl.[7] ..... B25D 19/00

(52) U.S. Cl. ..... 173/205; 173/93.7; 173/121; 81/463; 81/466

(58) Field of Search ..... 173/121, 122, 173/205, 124, 93, 93.7; 81/466, 463, 465

(56) References Cited

U.S. PATENT DOCUMENTS

| | | | | | |
|---|---|---|---|---|---|
| 376,581 | A | * | 1/1888 | Byrnes | 433/121 |
| 1,661,666 | A | * | 3/1928 | Maehren | 74/25 |
| 3,256,946 | A | * | 6/1966 | Jansen et al. | 173/97 |
| 3,366,187 | A | * | 1/1968 | Von Tersch | 173/93.6 |
| 3,783,956 | A | * | 1/1974 | Schultz | 173/93.7 |
| 4,909,216 | A | * | 3/1990 | Groddeck | 123/386 |
| 5,012,709 | A | * | 5/1991 | Su | 81/466 |
| 5,908,076 | A | * | 6/1999 | Marcengill et al. | 173/93 |
| 6,408,951 | B1 | * | 6/2002 | Lin | 173/203 |

* cited by examiner

*Primary Examiner*—Scott A. Smith
(74) *Attorney, Agent, or Firm*—Darby & Darby

(57) ABSTRACT

An impact tool driver includes a hollow holding member having a surrounding wall defining a chamber. A solid and rigid shank of a handle is formed with a V-shaped cam hole, and extends into the chamber such that the V-shaped cam hole is registered with two diametrically disposed pin holes in the surrounding wall. A compression spring is disposed within the chamber in the holding member, and abuts against the shank and the holding member. A pin extends through the pin holes in the surrounding wall and the cam hole in the handle, and slidably contacts a cam face that defines the cam hole.

1 Claim, 6 Drawing Sheets

IMPACT TOOL DRIVER

BACKGROUND OF THE INVENTION

1. Field of the Invention

The present invention relates to a tool driver, more particularly to an impact tool driver.

2. Description of the Related Art

Referring to FIGS. 1 and 2, a conventional impact tool driver is shown to include an elongated handle 1, a solid holding member 2, a compression spring 4, and a socket 205.

As illustrated, the handle 1 has an impact end 102 and a coupling end 103 opposite to the impact end 102, and defines a spring-receiving chamber 105 adjacent to the coupling end 103. The handle 1 is formed with a V-shaped cam hole 101 which is adjacent to the coupling end 103 and which is defined by a cam face 101W.

The solid holding member 2 has a mounting end 202 and a coupling end 203 opposite to the mounting end 202, and is formed with a pin hole 204 adjacent to the mounting end 202. The mounting end 202 of the solid holding member 2 extends into the spring-receiving chamber 105 in the handle 1 in such a manner that the pin hole 204 in the holding member 2 is registered with the cam hole 101 in the handle 1 in a radial direction of the handle 1. The socket 205 is mounted on the coupling end 203 of the holding member 2, and has a non-circular retention hole for receiving a tool bit or a workpiece (not shown).

The compression spring 4 is disposed within the spring-receiving chamber 105 in the handle 1, and abuts against the coupling end 202 of the holding member 2.

The pin 3 extends through the pin hole 204 in the holding member 2 and the cam hole 101 in the handle 1, and is in sliding contact with the cam face 101W in such a manner that the cam face 101W moves toward the coupling end 202 of the holding member 2 when an impact force is applied to the impact end 102 of the handle 1, which, in turn, drives the pin 3 together with the holding member 2 to rotate relative to the handle 1, thereby tightening or loosening the workpiece (not shown).

One disadvantage of the conventional impact tool driver resides in that the rigidity and strength of the handle 1 is weakened due to the formation of the spring-receiving chamber 105 and the cam hole 101 therein.

SUMMARY OF THE INVENTION

Therefore, the object of this invention is to provide an impact tool driver which includes a holding member formed with a spring-receiving chamber so as to overcome the aforesaid disadvantage of the prior art.

According to the present invention, an impact tool driver includes: an elongated handle including a solid and rigid shank that has an impact end and a coupling end opposite to the impact end, and that is formed with a V-shaped cam hole adjacent to the coupling end, the V-shaped cam hole being defined by a cam face; a hollow cylindrical holding member having an open end, a closed coupling end opposite to the open end, and a surrounding wall extending from the open end to the closed coupling end and defining a spring-receiving chamber accessible from the open end, the surrounding wall of the cylindrical holding member being formed with two diametrically disposed pin holes and being sleeved on the handle in such a manner that the coupling end of the handle and the cam hole are disposed in the spring-receiving chamber and that the pin holes in the cylindrical holding member are registered with the cam hole in the handle in a radial direction relative to the cylindrical holding member; a compression spring disposed within the spring-receiving chamber in the cylindrical holding member and abutting against the coupling end of the shank and the coupling end of the cylindrical holding member; and a pin extending through the pin holes in the surrounding wall of the cylindrical holding member and the cam hole in the handle, and in sliding contact with the cam face of the handle in such a manner that the cam face moves toward the closed coupling end of the cylindrical holding member against urging action of the compression spring when an impact force is applied to the impact end of the shank, thereby driving the pin to rotate, which, in turn, results in rotation of the cylindrical holding member relative to the handle.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
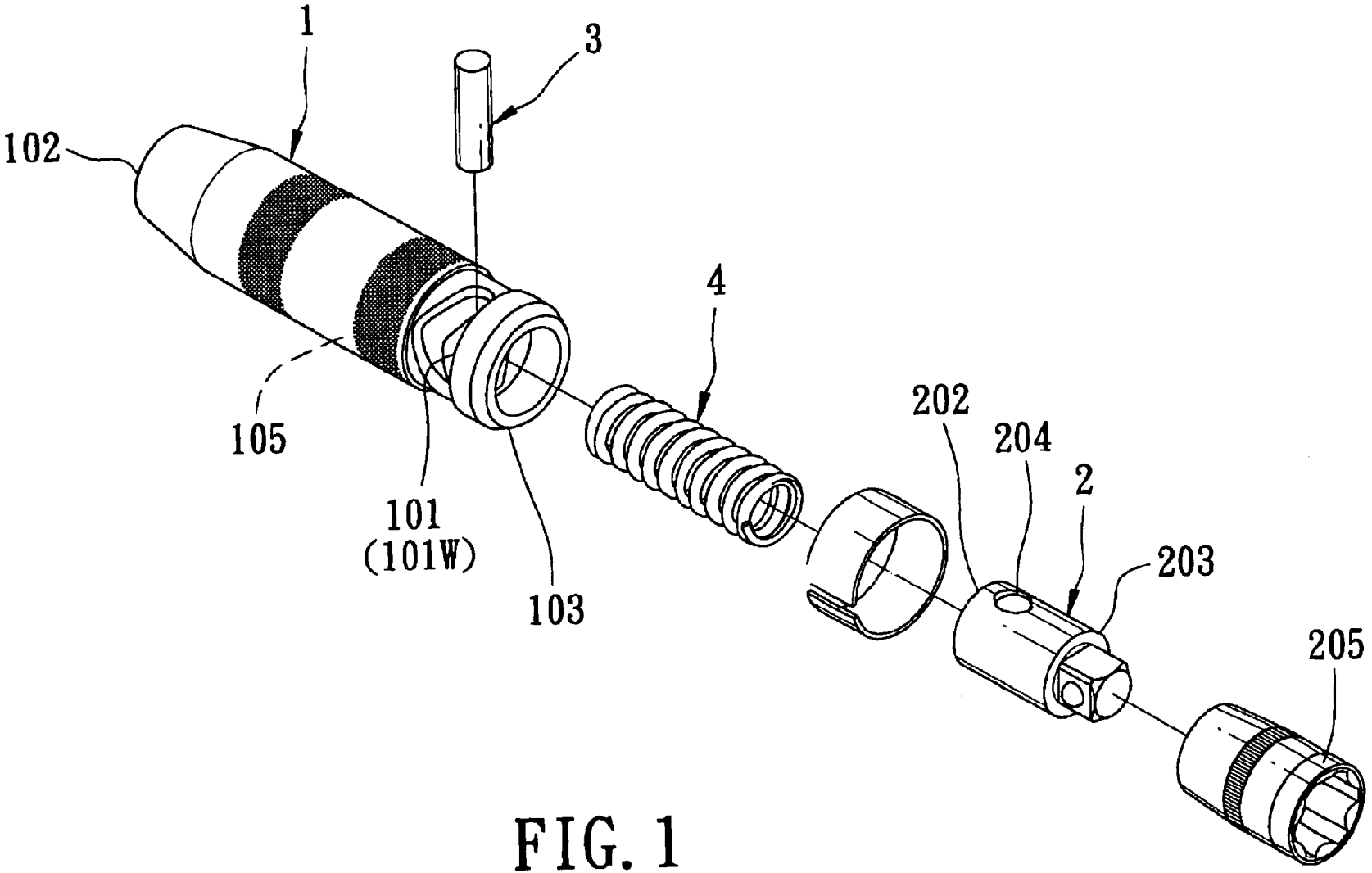
FIG. 1 PRIOR ART
FIG. 1 is an exploded perspective view of a conventional impact tool driver.
Figure 2:
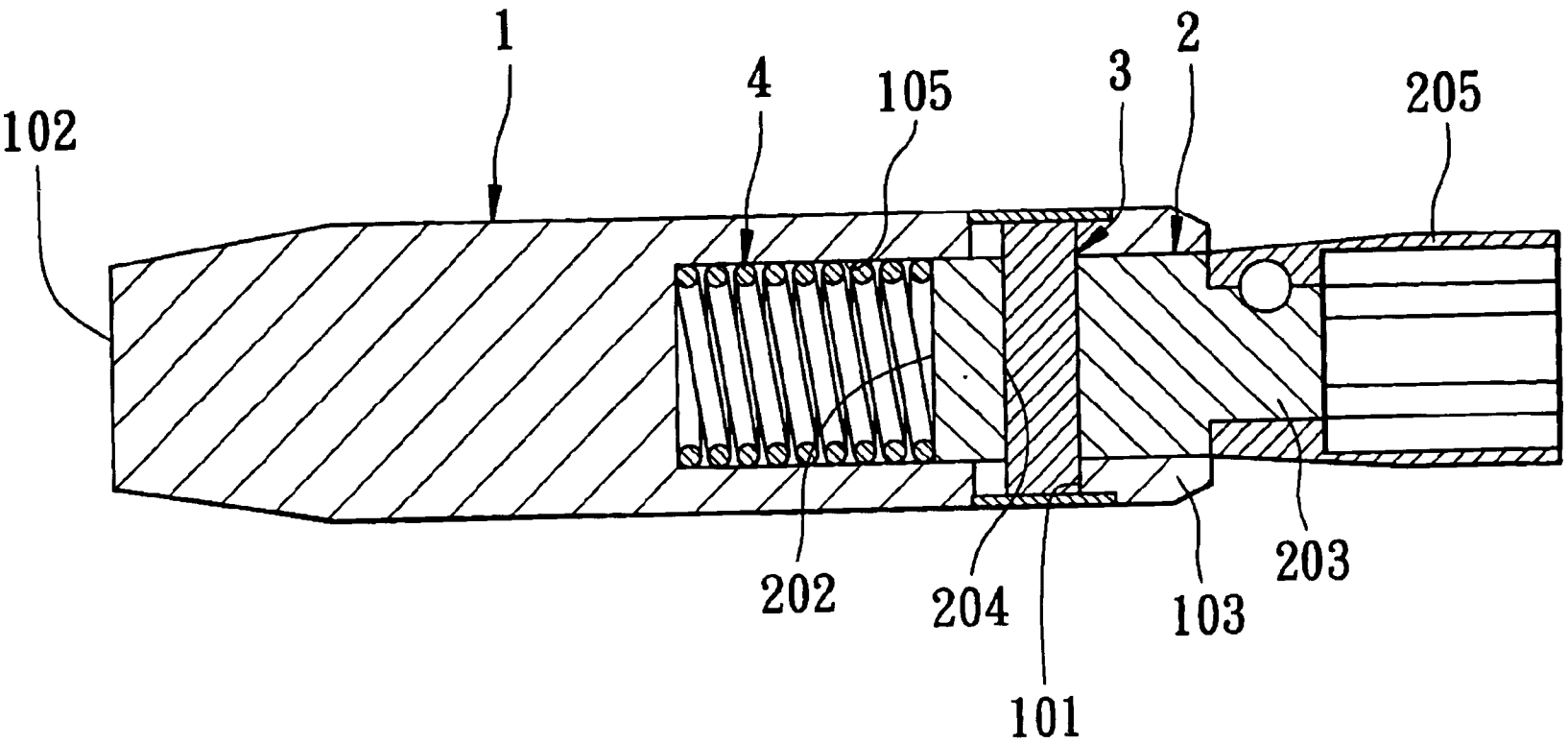
FIG. 2 PRIOR ART
FIG. 2 is an assembled sectional view of the conventional impact tool driver.
Figure 3:
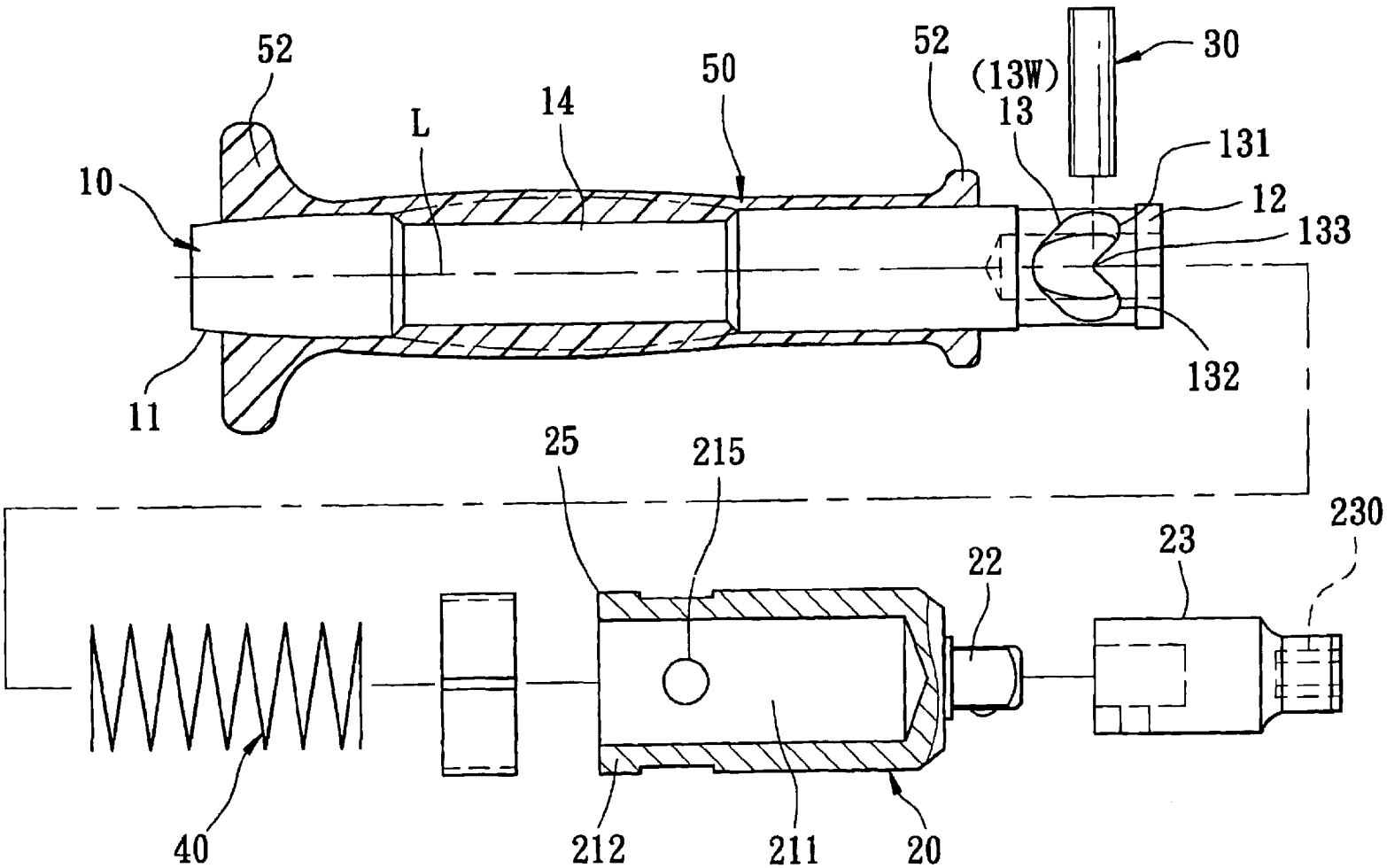
FIG. 3 is a partly sectional exploded view of the preferred embodiment of an impact tool driver according to the present invention.
Figure 4:
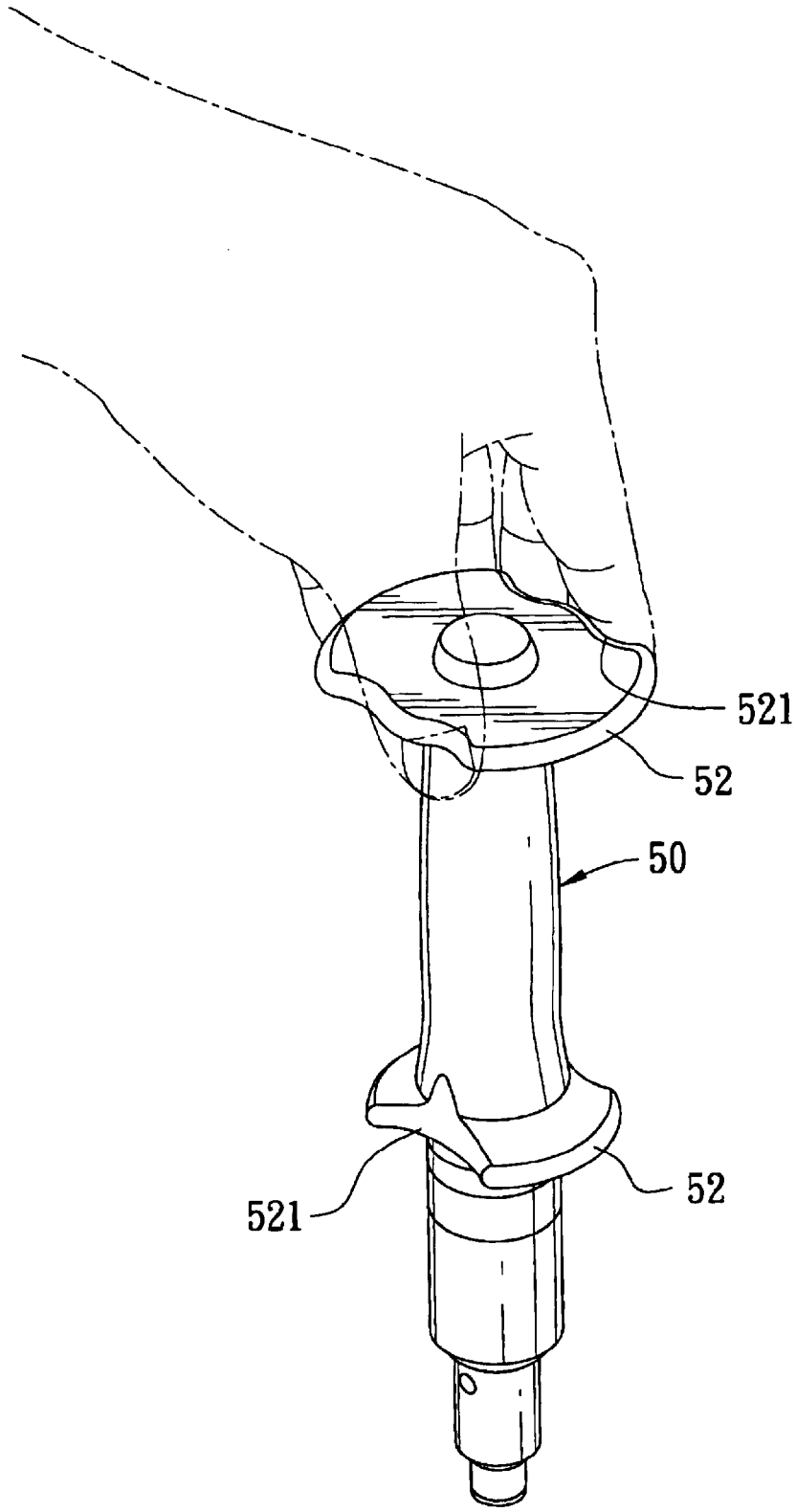
FIG. 4 is a perspective view illustrating how the preferred embodiment is operated in order to tighten or loosen a screw or a nut.
Figure 5:
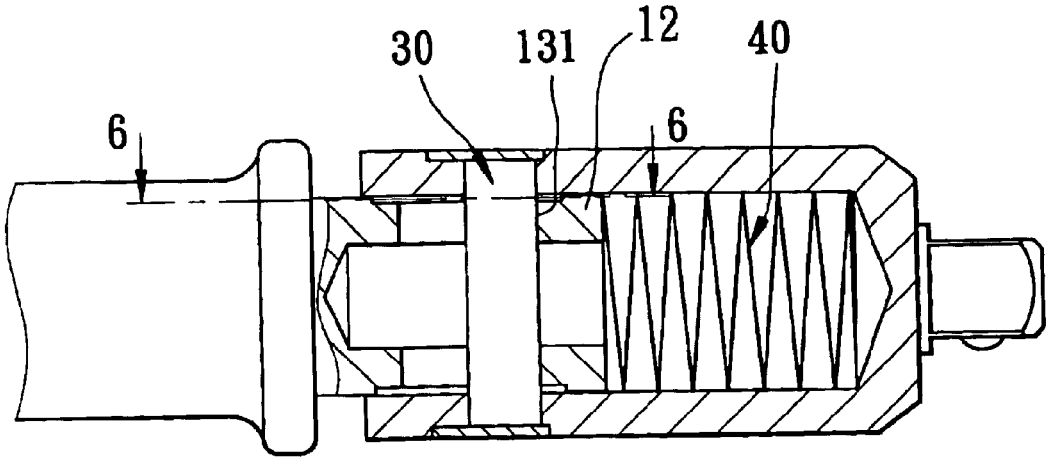
FIG. 5 is a fragmentary sectional view of the preferred embodiment.

Referring to FIGS. 3 to 5, the preferred embodiment of an impact tool driver according to the present invention is shown to include an elongated handle 10, a hollow cylindrical holding member 20, a compression spring 40, a socket 23, and a pin 30.

As illustrated, the handle 10 defines a rotating axis (L), and includes a solid and rigid shank 14 that has an impact end 11 and a coupling end 12 opposite to the impact end 11, and that is formed with a V-shaped cam hole 13 adjacent to the coupling end 12. The V-shaped cam hole 13 is defined by a cam face 13W having a pair of diametrically disposed first dead points 131 and a pair of diametrically disposed second dead points 132 adjacent to the coupling end 12 of the handle 10 and an apex 133 that is distal from the coupling end 12 of the handle 10 relative to the first and second dead points 131,132. An anti-slip sheath 50 is fixed on the shank 14 of the handle 10 to facilitate gripping. The sheath 50 includes two outward flanges 52 formed with finger-grooves 521 for ease of turning (see FIG. 4).

The cylindrical holding member 20 has an open end 25, a closed coupling end 22 opposite to the open end 25, and a surrounding wall 212 that extends from the open end 25 to the closed coupling end 22 and that defines a spring-receiving chamber 211 accessible from the open end 25. The surrounding wall 212 of the cylindrical holding member 20 is formed with two diametrically disposed pin holes 215, and is sleeved on the handle 10 in such a manner that the coupling end 12 of the handle 10 and the cam hole 13 are disposed in the spring-receiving chamber 211 and that the pin holes 215 in the cylindrical holding member 20 are registered with the cam hole 13 in the handle 10 in a radial direction relative to the cylindrical holding member 20.

The socket 23 is mounted detachably on the coupling end 22 of the cylindrical holding member 20, and has a non-circular receiving hole 230 to accommodate a driving bit (not shown), a screw head (not shown) or a bolt (not shown) for tightening or loosening the same.

The compression spring 40 is disposed within the spring-receiving chamber 211 in the cylindrical holding member 20, and abuts against the coupling end 12 of the shank 14 and the coupling end 22 of the cylindrical holding member 20.

Figure 6:
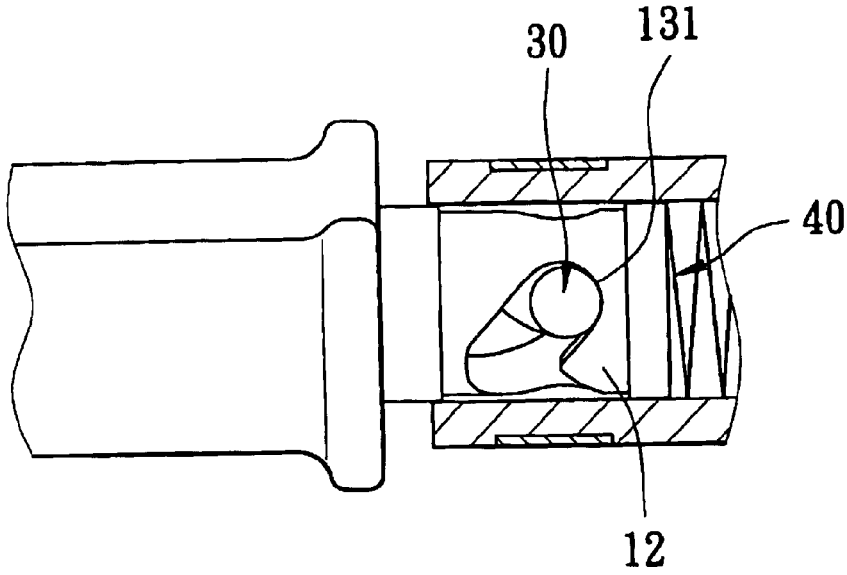
FIG. 6 is a fragmentary sectional view of the preferred embodiment taken along lines 6—6 in FIG. 5, illustrating the position of a pin in a cam hole prior to application of an impact force.

The pin 30 extends through the pin holes 215 in the surrounding wall 212 of the cylindrical holding member 20 and the cam hole 13 in the handle 10, and is in sliding contact with the cam face 13W. The pin 30 has two opposite ends that rest respectively on the pair of the first dead points 131 of the cam face 13W or on the pair of the second dead points 132 of the cam face 13W prior to application of an impact force to the handle 10, as best shown in FIG. 6.

Figure 7:
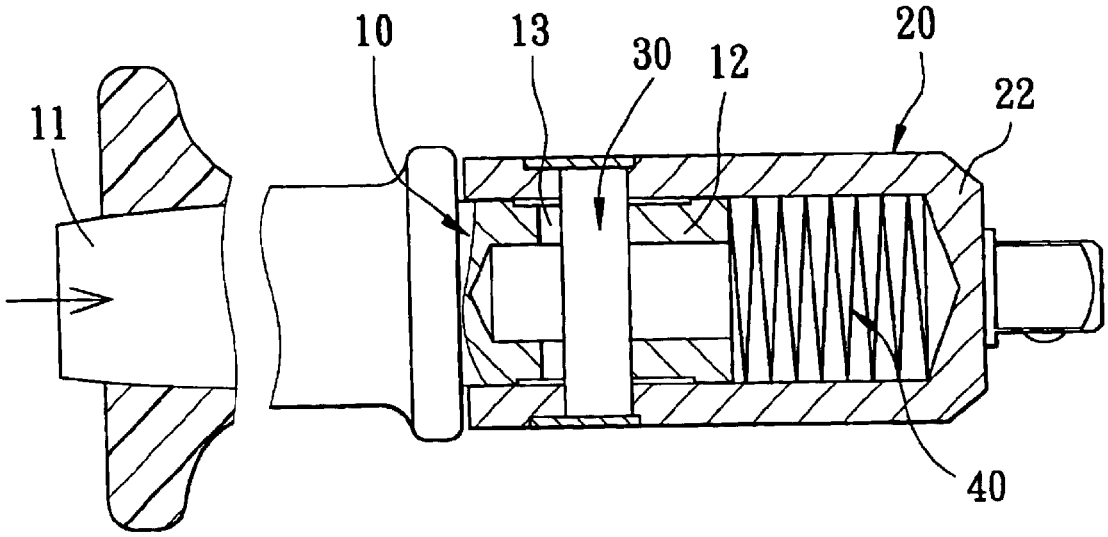
FIG. 7 is a fragmentary sectional view, illustrating how the preferred embodiment responds to an impact force.
Figure 8:
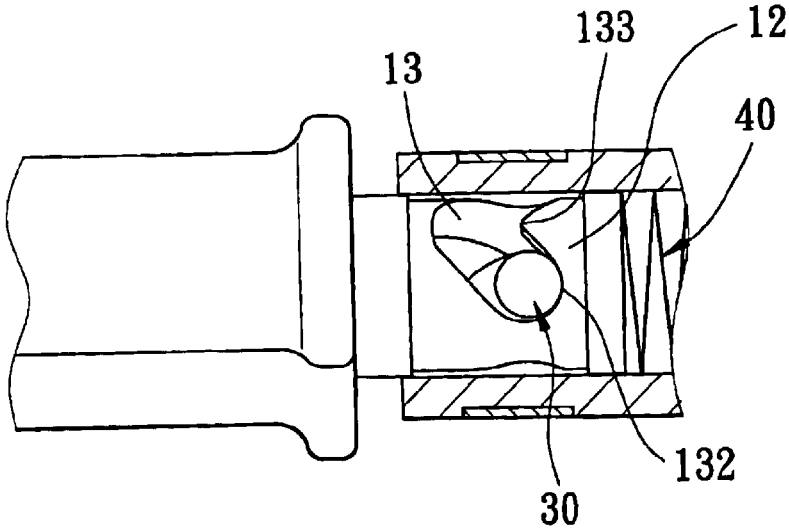
FIG. 8 is a fragmentary sectional view illustrating the position of the pin in the cam hole after application of the impact force.

When an impact force is applied to the impact end 11 of the handle 10, as shown in FIG. 7, assuming that the pin 30 rests initially on the first dead points 131, the cam face 13W (see FIG. 3) of the handle 10 moves toward the closed coupling end 22 of the cylindrical holding member 20 against urging action of the compression spring 40, which is swiftly compressed so as to accumulate a restoration force, and which urges the coupling end 12 of the handle 10 and the pin 30 when the impact force is relieved so as to drive the pin 30 together with the cylindrical holding member 20 to rotate about the rotating axis (L) (see FIG. 3), as shown in FIG. 8, where the pin 30 rests on the second dead points 132, thereby loosening or tightening a workpiece disposed in the receiving hole 230 in the socket 23. Rotation of the cylindrical holding member 20 in a clockwise or counter-clockwise direction can be arranged according to the pattern of the cam face 13W that defines the cam hole 13 in the handle 10.

With the formation of the spring-receiving chamber 211 in the cylindrical holding member 20, the aforesaid drawback as encountered in the conventional impact tool driver can be eliminated.

With this invention thus explained, it is apparent that numerous modifications and variations can be made without departing from the scope and spirit of this invention. It is therefore intended that the invention be limited only as indicated in the appended claims.

I claim:

1. An impact tool driver comprising:

an elongated handle including a solid and rigid shank that has an impact end and a coupling end opposite to said impact end, and that is formed with a V-shaped cam hole adjacent to said coupling end, said V-shaped cam hole being defined by a cam face;

a hollow cylindrical holding member having an open end, a closed coupling end opposite to said open end, and a surrounding wall extending from said open end to said closed coupling end and defining a spring-receiving chamber accessible from said open end, said surrounding wall of said cylindrical holding member being formed with two diametrically disposed pin holes and being sleeved on said handle in such a manner that said coupling end of said handle and said cam hole are disposed in said spring-receiving chamber and that said pin holes in said cylindrical holding member are registered with said cam hole in said handle in a radial direction relative to said cylindrical holding member;

a compression spring disposed within said spring-receiving chamber in said cylindrical holding member and abutting against said coupling end of said shank and said coupling end of said cylindrical holding member; and a pin extending through said pin holes in said surrounding wall of said cylindrical holding member and said cam hole in said handle, and in sliding contact with said cam face in such a manner that said cam face moves toward said closed coupling end of said cylindrical holding member against urging action of said compression spring when an impact force is applied to said impact end of said shank, thereby driving said pin to rotate, which, in turn, results in rotation of said cylindrical holding member relative to said handle.

* * * * *